US005772131A

United States Patent [19]

Dal Maso

[11] Patent Number: 5,772,131

[45] Date of Patent: Jun. 30, 1998

[54] KNEADER FOR PAPER STUFF

[75] Inventor: Giancarlo Dal Maso, Schio, Italy

[73] Assignee: Comer Spa, Caltrano, Italy

[21] Appl. No.: 776,334

[22] PCT Filed: Jun. 4, 1996

[86] PCT No.: PCT/EP96/02426

§ 371 Date: Jan. 27, 1997

§ 102(e) Date: Jan. 27, 1997

[87] PCT Pub. No.: WO96/39557

PCT Pub. Date: Dec. 12, 1996

[30] Foreign Application Priority Data

Jun. 5, 1995 [IT] Italy ..... VI95 A 0092

[51] Int. Cl.[6] ..... B02C 18/12

[52] U.S. Cl. ..... 241/46.17; 241/260.1

[58] Field of Search ..... 241/46.11, 46.17, 241/260.1; 162/4, 261

[56] References Cited

U.S. PATENT DOCUMENTS

| | | | |
|---|---|---|---|
| 3,035,781 | 5/1962 | Wallen . | |
| 3,402,897 | 9/1968 | Willems | 241/46.17 |
| 4,460,132 | 7/1984 | Thumm et al. | 162/261 |
| 4,607,802 | 8/1986 | Lamort | 241/46.17 |

FOREIGN PATENT DOCUMENTS

| | | | |
|---|---|---|---|
| 0126632 | 11/1984 | European Pat. Off. . | |
| 3123288 | 12/1982 | Germany . | |
| 404002894 | 1/1992 | Japan | 241/46.17 |
| 877389 | 9/1961 | United Kingdom . | |

*Primary Examiner*—Mark Rosenbaum

*Attorney, Agent, or Firm*—Watson Cole Grindle Watson, P.L.L.C.

[57] ABSTRACT

The invention discloses a kneader for the preparation of paper stuff comprising: a substantially cylindric tank (2; 120) having on the internal wall, vertical ribs (21) able to interrupt the rotation of the stuff stream; a rotor (13; 130) having a vertical axis (X; Y) located inside said tank (2; 120) and provided with blades (32; 132) spiral shaped. The external edge of each said blade presents an holding wing (34; 134) which is continuous and oriented towards the bottom of the tank and said wing developes itself from the beginning of each blade, starting from the rotor part farthest from the bottom, ending almost at one turn before the end of the spiral on the bottom.

9 Claims, 4 Drawing Sheets

KNEADER FOR PAPER STUFF

BACKGROUND OF THE INVENTION

The invention concerns a kneader for the preparation of paper stuff.

It is known that in the paper industries equipment named kneaders are used for the preparation of paper stuff obtained by introducing waste paper in a water bath. The percentage of the paper in water can be between 1 and 6% in so-called low density kneaders while it can be from 12 to about 18% in so-called high density kneaders.

The action of the kneader consists in dividing the cellulose fibres and making an homogeneous suspension of the same fibres in water. Another important function is separating the ink which pollutes the paper, from cellulose fibres, in order to recover the fibres and reconstitute new paper free of ink.

The specific action of the kneader is a maceration and a continuous mixing up of the paper through a truncated conic rotor, with the larger base on the bottom of the tank, which presents several blades wound as a spiral longways the rotor axle.

The paper stuff is conveyed through the channel formed by the spirals of the blades to the bottom and then it goes up from the bottom to the top in order to go back again and for several times through said rotor. The separation of the paper from the ink is obtained by rubbing between contiguous cellulose fibres and said rubbing occurs during the descending of the paper stuff across the spirals of the channel formed by the rotor blades. It is therefore plain that longer is the permanence time of the paper stuff across the channel formed by the rotor blades, greater is the rubbing effect and therefore the separation and the homogenisation of the paper fibres. The rotors at present available, according to the actual technique used for the kneaders, are rotors with multiple principles with three or more blades having, as said, truncated conic form with the larger base towards the bottom and in which the section of every blade forms an angle with the rotor axis which is generally different from the right angle, according to a vertical section of the rotor which contains the axis of the same rotor.

Some rotors exist with acute angle between the blade section and the shaft axis with an opposite direction to the tank bottom. Nevertheless rotors exist too with blades which form an obtuse angle instead of an acute one as before defined. It has been observed that the rotors having an acute angle, as above defined, are more efficient in kneading compared to those having an obtuse angle. It has been observed too that the blade part, which works during the rotation, is just a small peripheral area compared to all the superficial extension of the blade having helicoidal form.

It has been observed also that worn rotors, to be replaced after many working hours, had the most part of the surface of the blades not abraded and so reasonably it has been concluded that, during the normal running of the kneader, the stream of the paper stuff did not regard the main part of the spiral and of the blade surface, but only the peripheral part which it was observed to be abraded.

Regarding what has been said above, that is to say the kneading of the paper is obtained by running between the contiguous cellulose fibres during the sliding along the spiral of the rotor, if only a little part of the stuff stream is canalised inside the rotor and if the main part remains out of the rotor by the centrifugal effect, it is evident that the kneading time must be superior compared to the theoretical time which could take a rotor where the blade works completely.

The same thing can be said for the absorbed power as it is clear that the material expelled from the rotor due to the centrifugal force has a resistance against the rotation of said rotor, and from this derives an higher absorption power.

SUMMARY OF THE INVENTION

The aim of the present invention is to overcome the mentioned disadvantages. It is intended to realise a kneader whose rotor has such characteristics to maintain the paper stuff in the spirals of the rotor itself, among the blades, so that the blades work in an uniform and continuous manner along all the surface.

It is intended to also obtain a more efficient, rubbing action among the cellulose fibres so to carry out a more efficient separation between ink and fibres.

Further, it is intended to obtain that the kneader object of the invention can bear an higher concentration of paper in water when the same power is applied to the rotor axle.

All the aims before mentioned, and others that later will be better evidenced, are obtained from a kneader for the preparation of paper stuff comprising:

a tank having substantially a cylindrical form presenting, on the internal wall, vertical ribs able to interrupt the rotation of the stream;

a rotor having a vertical axle positioned inside said tank and provided with blades, spiral shaped, characterised in that the external edge of each said blade presents a continuous, holding wing oriented towards the bottom of the tank, said wing developing itself at the beginning of each blade, starting from the rotor part farthest from the bottom, ending at almost one turn before the end of the spiral on the bottom.

Advantageously according to the invention, it is possible to obtain that the wing made on the external edge of the blades, operates an holding effect on the stuff stream avoiding the centrifugal effect that causes the slipping of the stream out of the rotor.

In fact, the presence of the wing on the edge, realises a centripetal component which acts on the stuff stream and draws it towards the rotor axle.

As a resulting effect, the paper stream fills all the channel formed by the rotor blades in an homogeneous manner. With the rotor, object of the invention, it can be obtained that using the same power, the concentration of paper in water can be increased obtaining a significant saving of water or the power can be decreased with evident benefit. Further it can be obtained that the necessary time for kneading is decreased as the rotor carries out the kneading operation more efficientely. Also the separation between ink and cellulose fibres is improved as the sliding effect among the fibres increases remarkably.

BRIEF DESCRIPTION OF THE DRAWINGS

Further characteristics and details of the invention will be better pointed out during the description of a preferred embodiment of the invention given as an example but not as a restriction and explained in the enclosed drawings, where.

DESCRIPTION OF THE INVENTION

Figure 1:
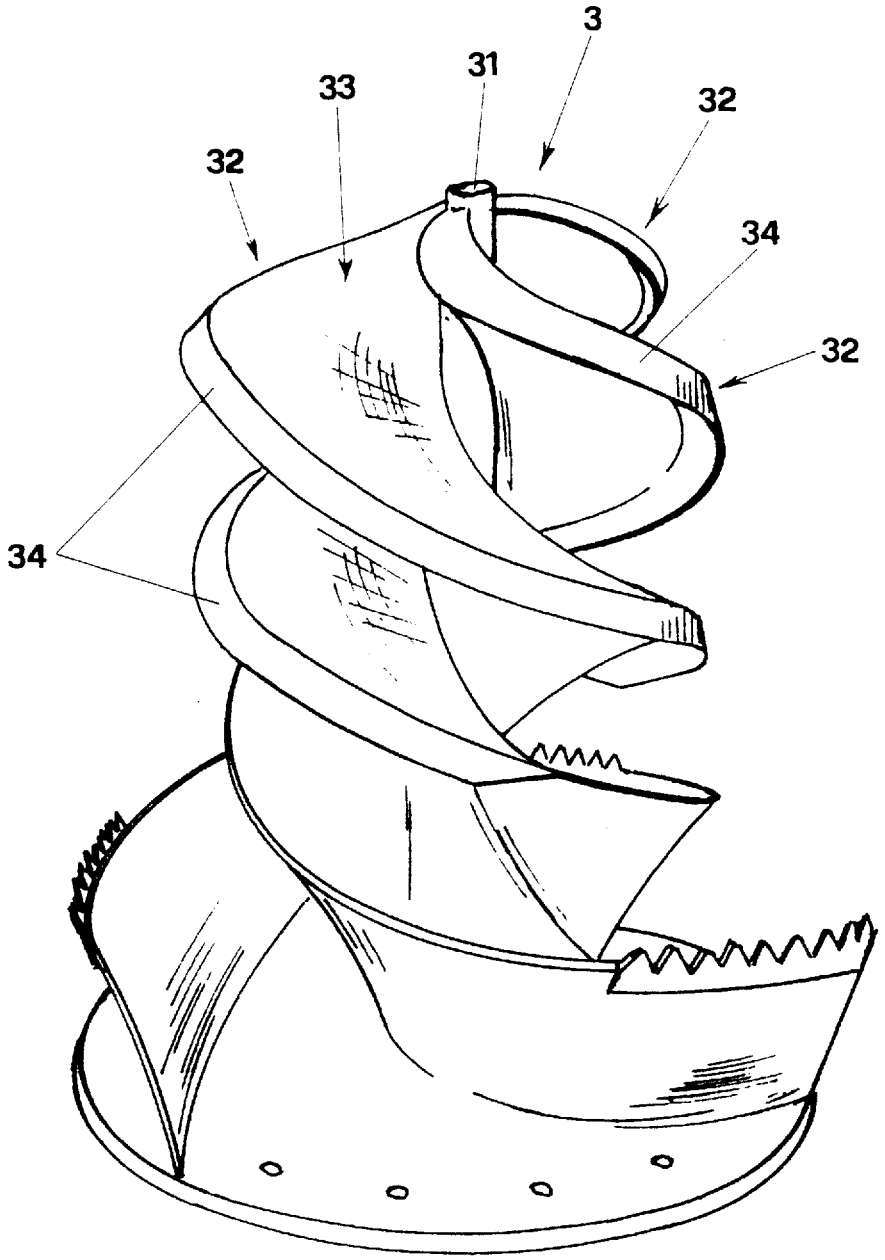
FIG. 1 shows the prospectic view of the kneader's rotor object of the invention.
Figure 2:
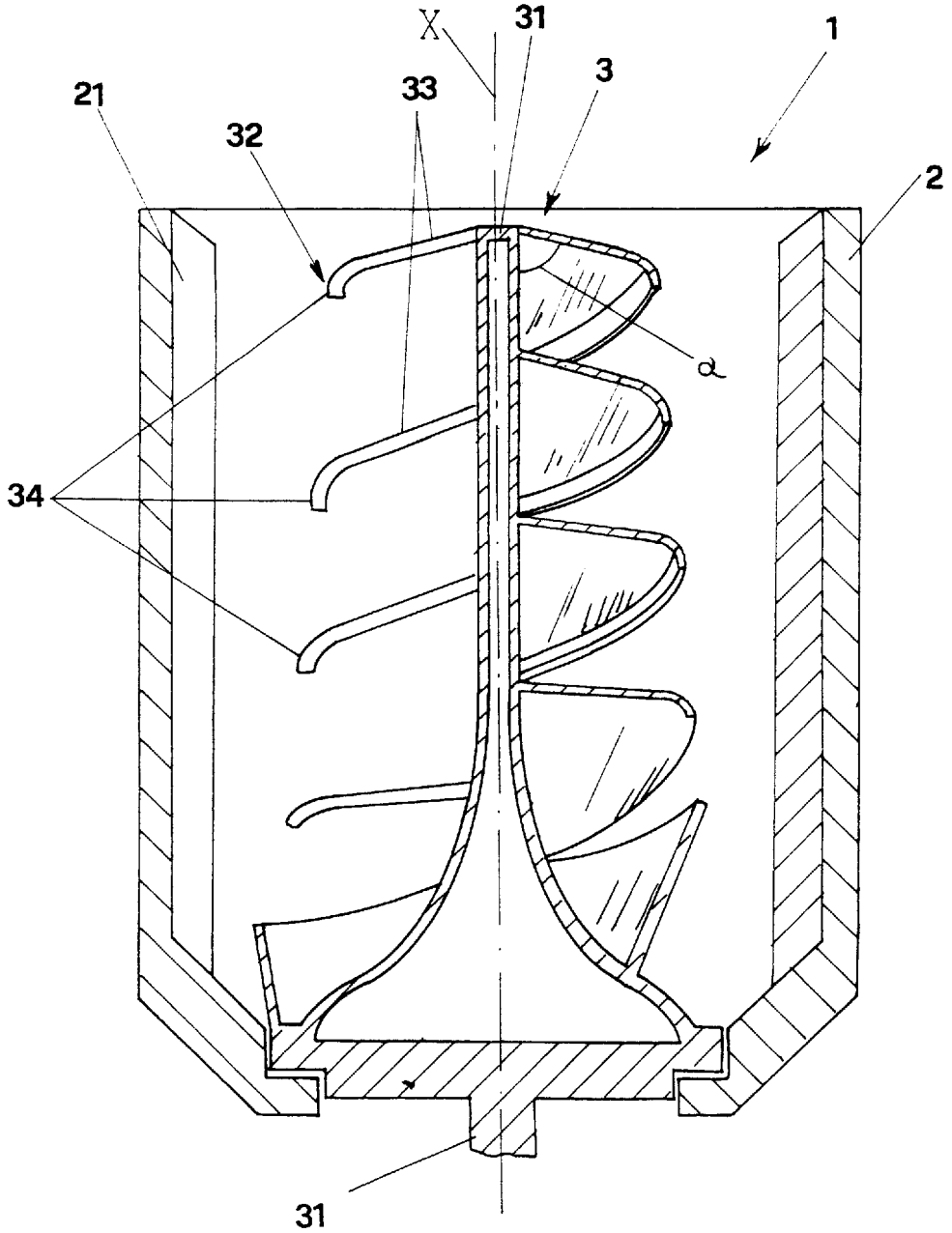
FIG. 2 shows a section of the kneader object of the invention.

With reference to said drawings, it can be observed in FIG. 2 the section of the kneader object of the invention, stated with 1. Such kneader presents a cylindrical tank 2 having a set of vertical ribs 21 able to interrupt the rotation of the stream moved on by the rotor. On the bottom a rotor 3 is placed whose shaft 31 is moved by an engine not represented in the drawing. The rotor is formed by three blades 32 each one is spiral shaped and winds the axis X of the shaft 31 of rotor 3 having a surface widening as it arrives towards the bottom, as it can be observed in FIG. 1. The surface 33 of each blade 32 joins the shaft of the rotor with an angle $\alpha$ which, with reference to a vertical section of the same rotor, is less than 90° against the axis X of the shaft 31 with direction towards the bottom of the tank. Such angle makes easier to convey the stuff stream to the centre of the rotor and helps the holding and the maintaining of the stuff towards the centre.

As it can be observed in both FIG. 1 and FIG. 2, on the external edge of each blade 32 a continuous, holding wing is present, stated with 34, which is oriented towards the bottom of the tank. Such wing is developed from the beginning of each blade, starting from the top and ending almost at one turn before the end of the spiral. The action of the wing 34 develops a centripetal component which acts on the stuff's mass, which is canalised between two blades, so that the same mass is pushed towards the centre and occupies all the surface 33 of the blade.

In this way the staff's mass which slips out because of the centrifugal effect from its spinning around the rotor is almost negligible.

Figure 3:
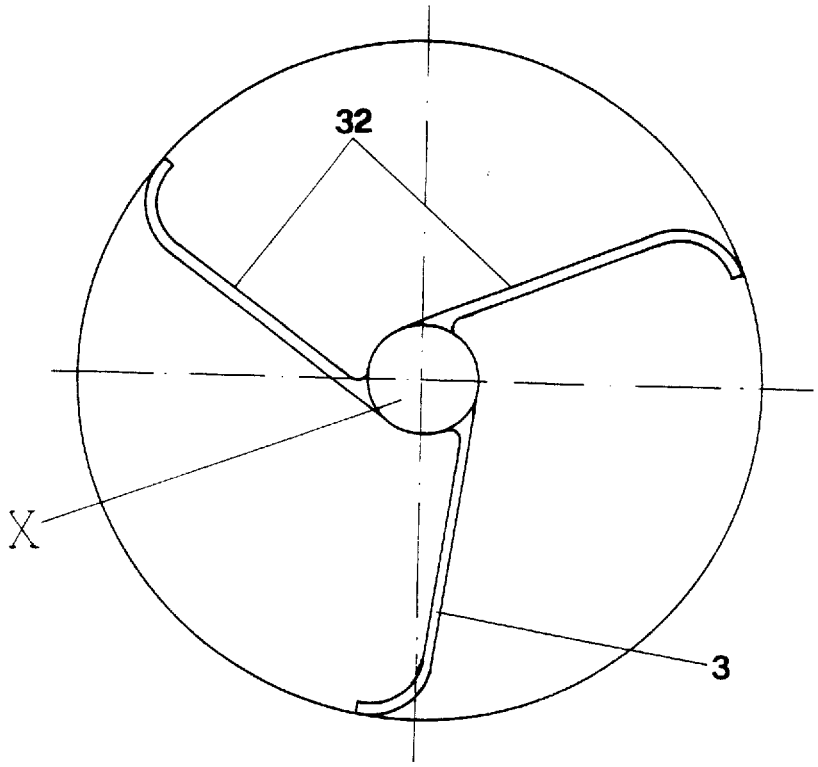
FIG. 3 shows the blades of the rotor according to a section tangent to the rotating axle of the same rotor.
Figure 4:
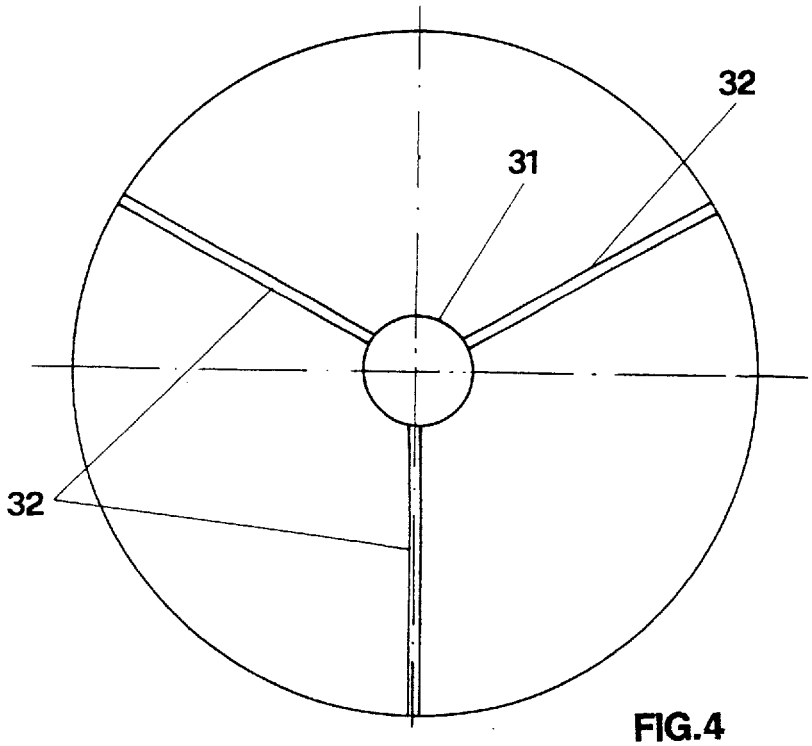
FIG. 4 shows a section of the blades of the rotor of the kneader according to a different embodiment.

FIG. 4 shows a possible disposition of the rotor blades against to an horizontal plane, perpendicular to the axle 31 of the rotor 3. In FIG. 3 the coupling of the blades with the axle 31 is of radial form. In fact the blades 32 are like radius, starting from the centre.

In a preferred embodiment, shown in FIG. 3, the blades 32 are tangent to the sharf 31. The wings 34 are, as mentioned, directed towards the bottom but their angle can vary, following the manufacturing of the rotor, depending from the number of the blades of the rotor and from the centrifugal force that it is intended to give to the mass of the stream among the blades.

Figure 5:
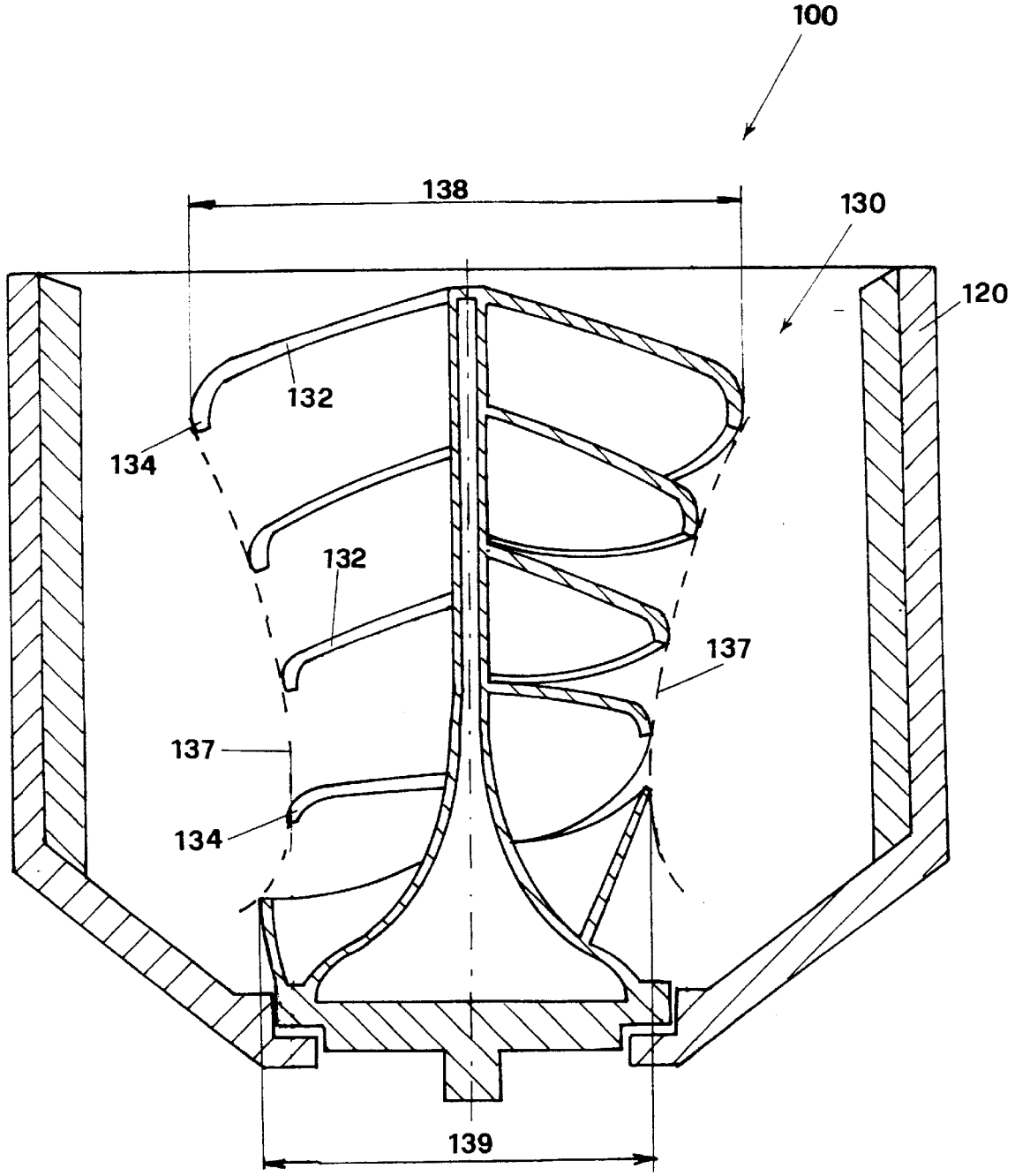
FIG. 5 shows a longitudinal section of a different embodiment of the kneader object of the invention.

A different embodiment of the kneader object of the invention is represented in FIG. 5 where it can be observed that said kneader, stated with 100, is provided with a rotor 130 having a vertical axis Y where the continuous, holding wings 134, located on the external edge of the blades 132, are lined up to an arc 137. The rotor 130, on the whole, assumes in this way a conoid profile having a lateral concave surface, converging towards the bottom of the tank 120 where the rotor 130 is held as represented in FIG. 5.

The shape of such arcs 137 to which said continuous, holding wings 134 are lined up, establishes for said rotor 130 at the superior end, a diameter 138 greater than the lower diameter 139 at the base, on the bottom of the tank 120.

Increasing the diameter of the rotor from the base to the upper extremity, it can be obtained the advantage to pick up the stream during the ascending so that the stream at the external surface of the rotor, having in the inner part an extensive vacuum, looses its possibility to be supported and breaks down easily.

Further, this fact permits also to work with higher density stuff obtaining greater production yield.

According to what has been said, it can be understood that the kneader object of the invention, in both described embodiments, reaches the established aims.

Eventual different embodiments of the kneader, object of the invention, are to be considered protected by the present invention.

I claim:

1. A kneader for processing a stream of paper stuff comprising:

a substantially cylindrical tank having an upstanding internal wall; inwardly extending vertical ribs formed in the wall; and a rotor including a central shaft portion having a vertical axis located inside said tank and a spiral shaped blade having upper and lower ends and multiple turns extending outwardly of the shaft portion, an external edge of said blade formed with a depending holding wing oriented towards the bottom of the tank, and extending continuously along turns of the spiral blade from the upper end of the blade to about one turn from the lower end of the blade.

2. The kneader according to claim 1 wherein the blade is formed with a surface portion oriented at an angle ($\alpha$), with reference to a vertical section of the rotor.

3. The kneader of claim 2 wherein said angle ($\alpha$) formed by the surface of each blade with the shaft of the rotor towards the bottom of the tank being less than about 90°.

4. The kneader according to claim 1 wherein a horizontal section of each blade perpendicular to the axis of said rotor is radial with respect to the axis.

5. The kneader according to claim 1 wherein a horizontal section of each blade perpendicular to the axis of said rotor is tangent to the shaft portion of said rotor.

6. The kneader according to claim 1 wherein a longitudinal section of the rotor portion is in the form of a truncated conic profile divergent towards the bottom of the tank.

7. The kneader according to claim 1 wherein a longitudinal section of the rotor portion is in the form of a truncated conoid profile having a lateral concave surface along the external edge.

8. The kneader according to claim 7 wherein said truncated conoid profile of said rotor diverges outwardly at the upper end and lower end of the blade.

9. The kneader according to claim 7 wherein an upper end of the concave surface has a large diameter at the top end of the blade.

* * * * *